US010753086B2

(12) United States Patent
Ben-Zeev

(10) Patent No.: US 10,753,086 B2
(45) Date of Patent: Aug. 25, 2020

(54) MODULAR FLOOR PLATFORM

(71) Applicant: World Housing Solution, Inc., Sanford, FL (US)

(72) Inventor: Ron Stocknopf Ben-Zeev, Winter Park, FL (US)

(73) Assignee: World Housing Solution, Inc., Sanford, FL (US)

( * ) Notice: Subject to any disclaimer, the term of this patent is extended or adjusted under 35 U.S.C. 154(b) by 0 days.

(21) Appl. No.: 15/585,884

(22) Filed: May 3, 2017

(65) Prior Publication Data

US 2017/0370100 A1 Dec. 28, 2017

Related U.S. Application Data

(60) Provisional application No. 62/330,924, filed on May 3, 2016.

(51) Int. Cl.

| | |
|---|---|
| ***E04B 5/08*** | (2006.01) |
| ***E04C 2/34*** | (2006.01) |
| ***E04C 2/22*** | (2006.01) |
| ***E04C 2/38*** | (2006.01) |
| ***E04B 5/02*** | (2006.01) |
| ***E02D 27/02*** | (2006.01) |
| ***E04B 1/00*** | (2006.01) |
| ***E04C 2/24*** | (2006.01) |
| ***E04C 2/54*** | (2006.01) |

(Continued)

(52) U.S. Cl.

CPC ..... *E04B 5/08* (2013.01); *E02D 27/02* (2013.01); *E04B 1/0007* (2013.01); *E04B 5/023* (2013.01); *E04B 5/026* (2013.01); *E04C 2/22* (2013.01); *E04C 2/243* (2013.01); *E04C 2/246* (2013.01); *E04C 2/34* (2013.01); *E04C 2/38* (2013.01); *E04C 2/50* (2013.01); *E04C 2/54* (2013.01); *E04C 2/543* (2013.01); *E04B 1/6137* (2013.01); *E04B 2103/04* (2013.01); *E04C 2002/001* (2013.01); *E04C 2002/004* (2013.01)

(58) Field of Classification Search

CPC ..... E04B 5/08; E04B 5/026; E04B 1/6137; E04B 2103/04; E04B 1/12; E04B 5/02; E04B 5/43; E04B 5/48; E04C 2/34; E04C 2/22; E04C 2/38; E04C 2/50; E04C 2002/001; E04H 1/02

USPC ..... 52/263, 271, 126.5, 126.6, 126.7

See application file for complete search history.

(56) References Cited

U.S. PATENT DOCUMENTS 3,150,748 A * 9/1964 Liskey, Jr. ..... E04F 15/02405 52/396.04

3,924,370 A * 12/1975 Cauceglia ..... E04F 15/0247 52/126.6

(Continued)

FOREIGN PATENT DOCUMENTS

| | | | |
|---|---|---|---|
| DE | 202011005513 | U1 | 10/2011 |
| GB | 2515519 | B | 6/2015 |
| GB | 2528768 | A | 2/2016 |

*Primary Examiner* — Phi D A

(74) *Attorney, Agent, or Firm* — Christopher M. Ramsey; GrayRobinson, P.A.

(57) ABSTRACT

A modular floor platform includes a floor made of a plurality of individual composite floor panels interconnected by tongue and groove joints. The individual composite floor panels have a foam core and a rigid cover over the foam core. A frame attaches the floor panels together along a perimeter of the floor. Legs beneath the frame and upwardly support the floor.

20 Claims, 10 Drawing Sheets

(51) Int. Cl.
*E04B 1/61* (2006.01)
*E04C 2/00* (2006.01)

(56) References Cited

U.S. PATENT DOCUMENTS 4,279,109 A * 7/1981 Madl, Jr. ..... E04F 15/02441 52/263
4,698,945 A * 10/1987 Munn ..... E04B 5/02 52/127.11
RE33,220 E * 5/1990 Collier ..... E04F 15/02452 174/490
5,072,557 A * 12/1991 Naka ..... E04F 15/02452 52/126.1
5,074,085 A 12/1991 Ueda
5,117,596 A 6/1992 Leslie et al.
5,499,476 A * 3/1996 Adams ..... E04F 15/02452 248/248
5,501,754 A * 3/1996 Hiraguri ..... E04F 15/02452 156/71
5,638,651 A * 6/1997 Ford ..... E04C 2/246 52/265
6,148,834 A 11/2000 Grooms
6,192,909 B1 2/2001 Strausser
6,526,614 B2 3/2003 Anderson et al.
6,802,160 B2 * 10/2004 Harambasic ..... E04B 1/04 446/124
7,520,096 B2 * 4/2009 Hiraguri ..... E04F 15/02476 52/126.1
7,770,344 B2 * 8/2010 Betz ..... H02G 3/385 52/126.6
8,112,947 B2 * 2/2012 Mead ..... E04F 15/02452 52/126.4
8,490,234 B2 * 7/2013 Rowell ..... E04F 15/0247 14/2.4
9,506,248 B1 11/2016 Fields et al.
2004/0074170 A1 * 4/2004 Huang ..... E04F 15/02452 52/220.1
2009/0145057 A1 * 6/2009 Tsukada ..... E04F 15/0247 52/126.6
2009/0226253 A1 9/2009 Towell
2013/0067838 A1 * 3/2013 Black ..... E04C 2/22 52/220.7
2015/0047271 A1 2/2015 Davis et al.
2015/0047289 A1 2/2015 Davie et al.
2015/0047291 A1 2/2015 Davis et al.

* cited by examiner

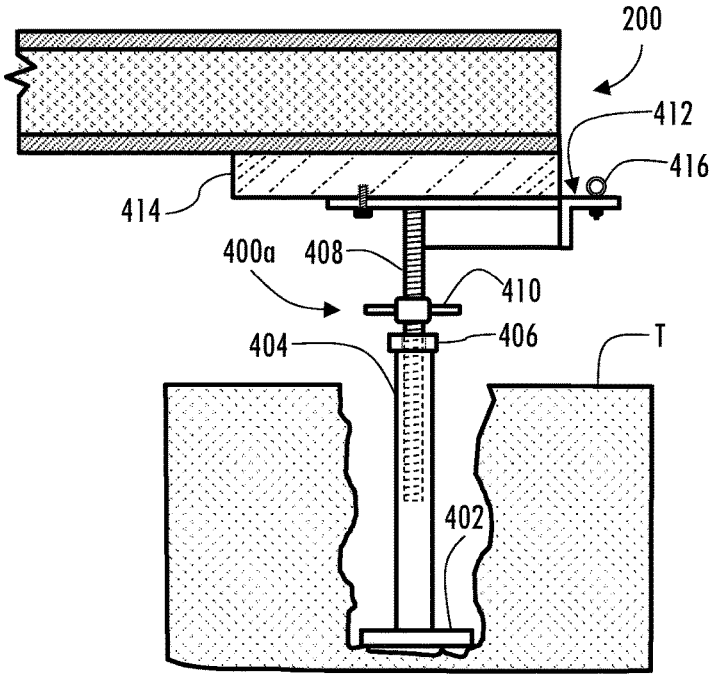
FIG. 16
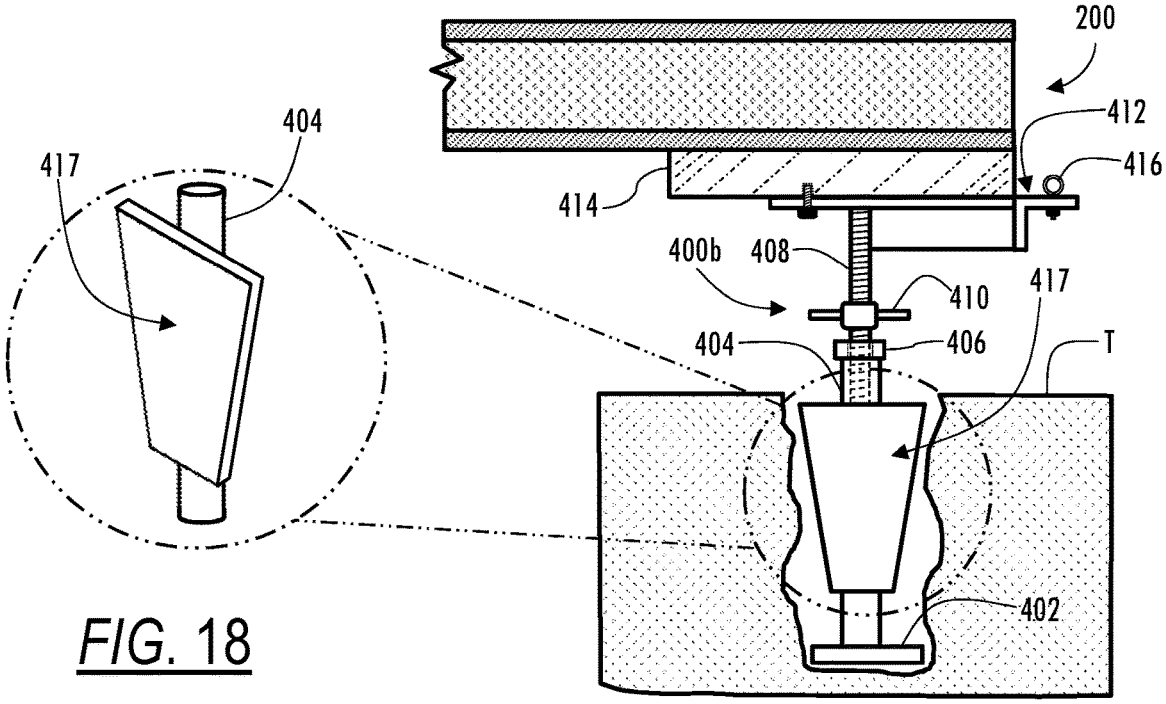
FIG. 18
FIG. 17

MODULAR FLOOR PLATFORM

CROSS-REFERENCE TO RELATED APPLICATION

This claims priority from U.S. provisional Application No. 62/330,924, filed May 3, 2016, which is incorporated by reference herein in its entirety.

FIELD

This relates to the field of modular structures and, more particularly, to modular flooring platforms.

BACKGROUND

When people need to stay in remote locations for an extended period of time, they often need more than a lightweight camping tent for shelter, so they construct more robust shelters made of soft-sided tents that are often associated with remote bases for the military or humanitarian operations. Such soft-sided tents that have been in use for decades because they are durable and can be reused many times.

It is common to construct a wooden platform on which to erect the tent to elevate the tent from the ground and to provide a level floor. Unfortunately, when the base needs to move, these wooden platforms are difficult if not impossible to move and reuse at the next location. The wooden platforms also rot and often need repair, especially in hot and wet locations. Likewise, the wooden platform does not provide sufficient thermal insulation to the floor, making heating and cooling the tents energy inefficient.

SUMMARY

What is needed is a modular platform that does not suffer from the drawbacks associated with wooden platforms and that can be constructed, deconstructed, transported, and reused repeatedly. Such a platform may be used as a base for tents or for hard-sided building structures, for example.

An example of such a modular floor platform comprises a floor made of a plurality of individual composite floor panels interconnected by tongue and groove joints. The individual composite floor panels have a foam core and a rigid cover over the foam core. A frame attaches the floor panels together along a perimeter of the floor. Legs are positioned beneath the frame and upwardly support the floor.

Another example of a modular floor platform comprises a plurality of individual composite floor panels. Each floor panel has (a) a foam core positioned between a planar upper surface and a planar lower surface of a rigid cover over the foam core and (b) a peripheral edge defining a tongue and groove joint member. The tongue and groove joint members of adjacent floor panels are mated together forming a flat floor. A frame attaches the floor panels together along a perimeter of the flat floor in such a way that the frame suspends the floor panels from an upper section of the frame. Legs beneath the frame upwardly support the floor.

A method of constructing a floor platform comprises arranging a plurality of legs on terrain in a pre-determined grid pattern; forming a floor upwardly supported on the legs by interconnecting tongue and groove joints of a plurality of individual composite floor panels and positioning respective tongue and groove joints against respective legs; and attaching the floor panels together along a perimeter of the floor with a frame.

The following optional features may be included in either of the floor platform examples and/or the method.

The individual composite floor panels may have a foam core and a rigid cover over the foam core and the rigid cover may include a planar upper surface and a planar lower surface opposite the planar upper surface. On at least some of the floor panels, the planar upper surface and planar lower surface extend beyond a peripheral edge of the foam core forming a groove of the tongue and groove joints between the planar upper surface and planar lower surface.

The individual composite floor panels may have a foam core and a rigid cover over the foam core and the rigid cover may include a planar upper surface and a planar lower surface opposite the planar upper surface. On at least some of the floor panels, the foam core extends beyond a peripheral edge of the planar upper surface and a peripheral edge of the planar lower surface forming a tongue of the tongue and groove joints.

The legs may upwardly support the floor by directly contacting the tongue and groove joints.

The floor may include at least one tongue and groove joint not directly contacting the frame and at least one of the legs may upwardly support the floor by directly contacting the at least one tongue and groove joint not directly contacting the frame.

The frame may include an upper section and the floor panels may be attached to the frame in such a way that the floor panels are suspended from the upper section.

BRIEF DESCRIPTION OF THE DRAWINGS

FIG. 16 is a schematic of a first example of a leg.

FIG. 17 is a schematic of a second example of a leg.

FIG. 18 is an expanded view of a section of the leg of FIG. 17.

DETAILED DESCRIPTION OF EXAMPLE EMBODIMENTS

Figure 1:
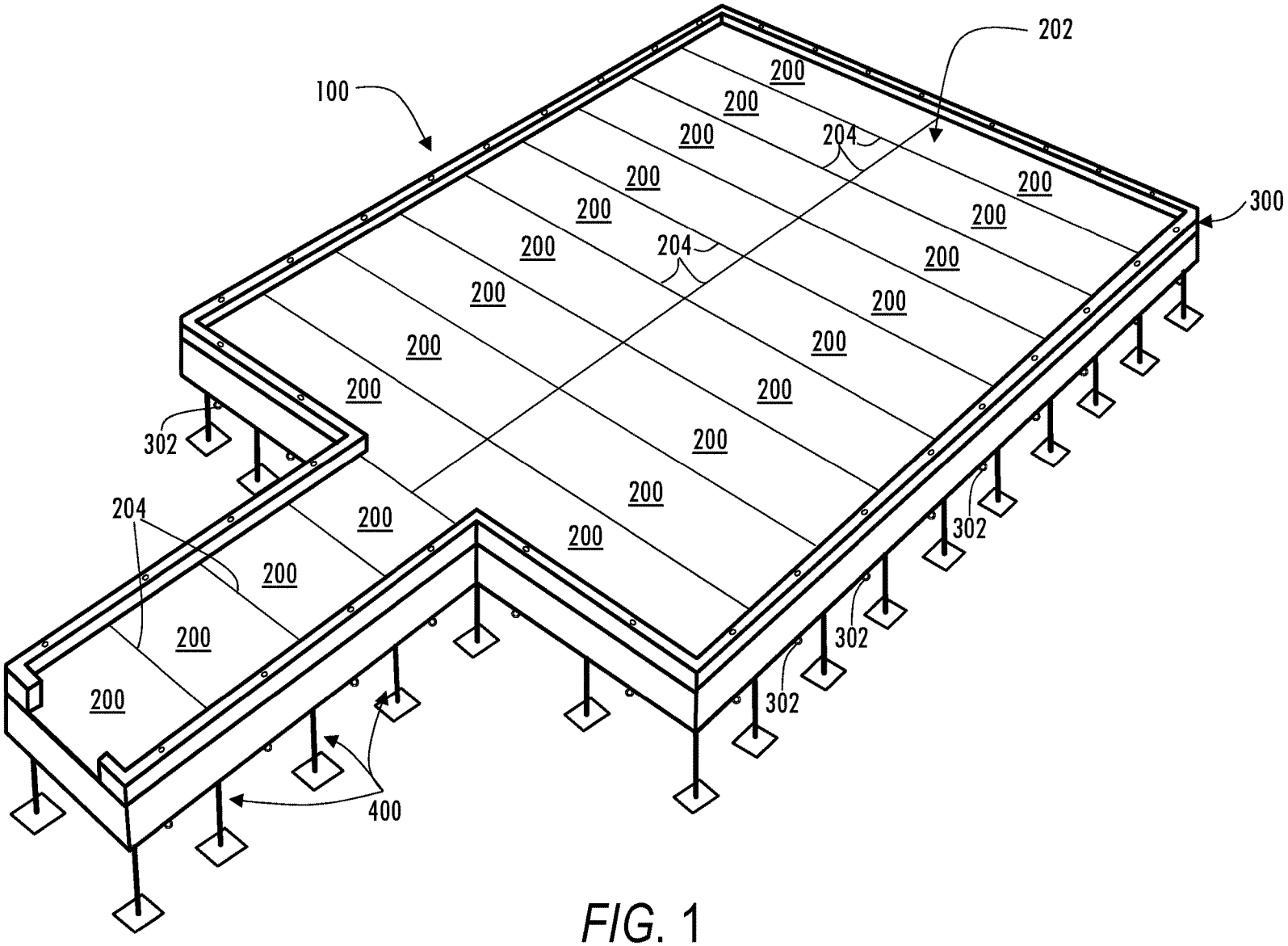
FIG. 1 is a top perspective view of an example of the modular floor platform.

Referring to FIG. 1, an example of the modular floor platform 100 includes a plurality of floor panels 200 interconnected to form a flat floor 202 with a frame 300 defining the perimeter of the floor 202 and attached to the floor panels 200 contacting the frame 300. A plurality of legs 400 upwardly support the floor 202 and frame above underlying terrain.

Figure 2:
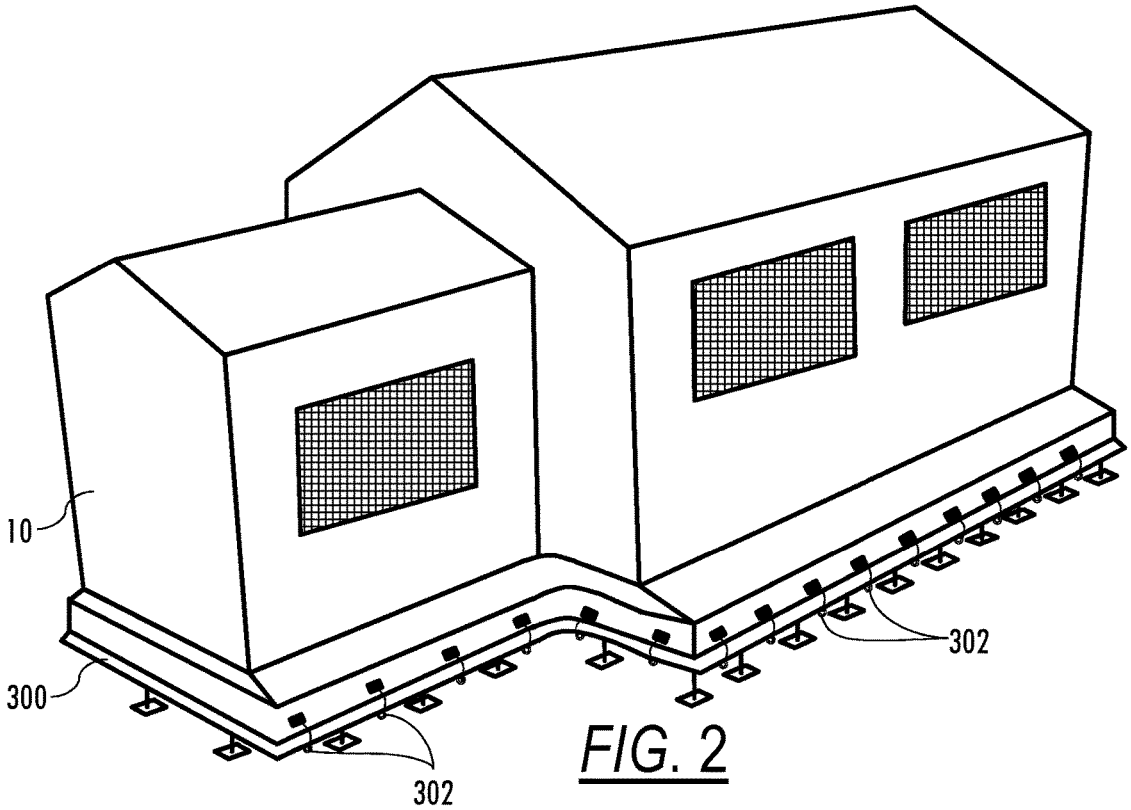
FIG. 2 is a perspective view of an example of the modular platform underlying a tent.

The floor platform 100 may be used as a flooring structure for a tent 10 as illustrated in FIG. 2. The platform 100 provides a level floor 202 that also supports the tent 10 above the underlying terrain. The tent 10 may be tethered to the platform 100 by attaching tethers 12 on the tent 10 to anchors 302 forming part of the platform 100. The design of the tent 10 in FIG. 2 is provided by way of illustration and does not limit the scope of possible tent designs that can be used with the platform 100.

Figure 3:
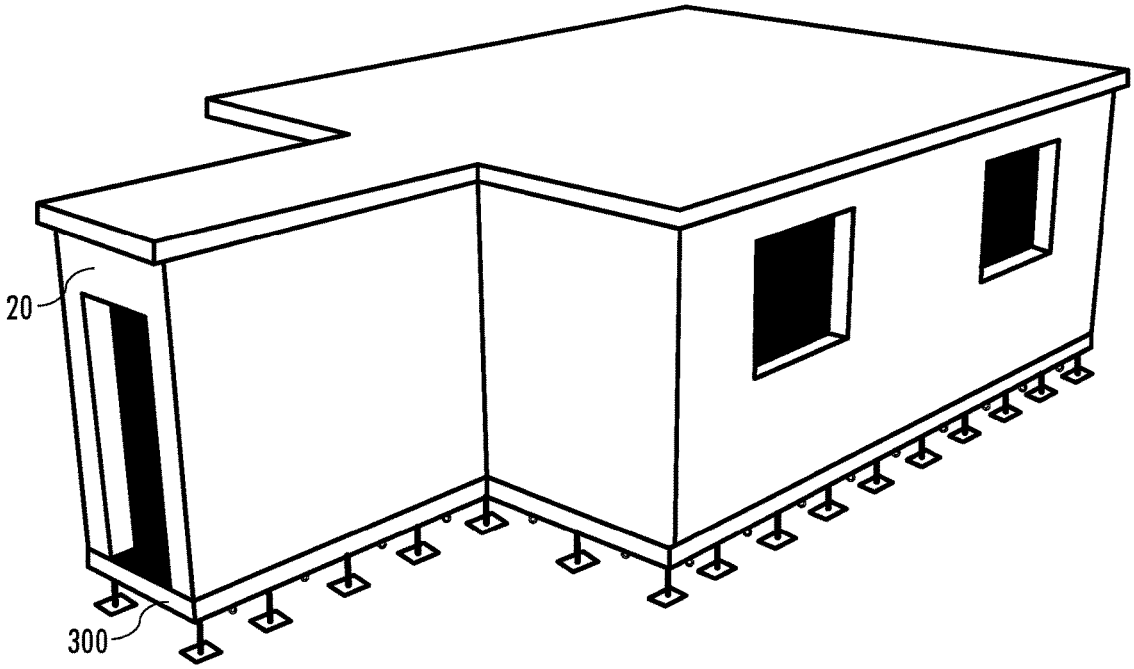
FIG. 3 is a perspective view of an example of the modular platform underlying a hard-sided building.

The floor platform 100 may also be used as a flooring structure for a hard-sided building 20 as illustrated in FIG. 3. The design of the building 20 in FIG. 3 is provided by way of illustration and does not limit the scope of possible building designs that can be used with the platform 100.

Referring back to FIG. 1, the floor panels 200 are arranged in a grid-type pattern. Adjacent floor panels 202 are interconnected together at a plurality of tongue and groove joints 204. The number of floor panels 200 and the shape of the floor panels 200 used for a particular situation may vary depending on how the platform 100 is intended to be used. Accordingly, the aesthetic design of the platform 100 is not limited to the example shown in FIG. 1.

Figure 4:
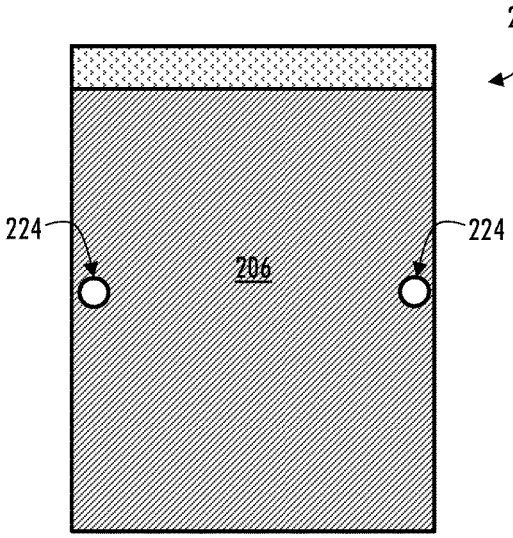
FIG. 4 is a top plan view of a first example of a floor panel.
Figure 5:
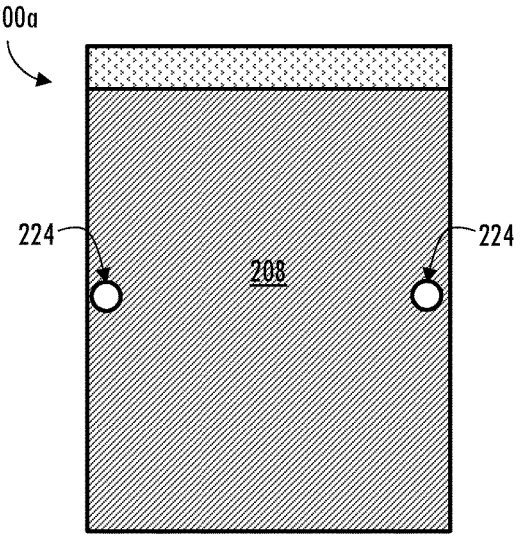
FIG. 5 is a bottom plan view of the floor panel of FIG. 4.
Figure 6:
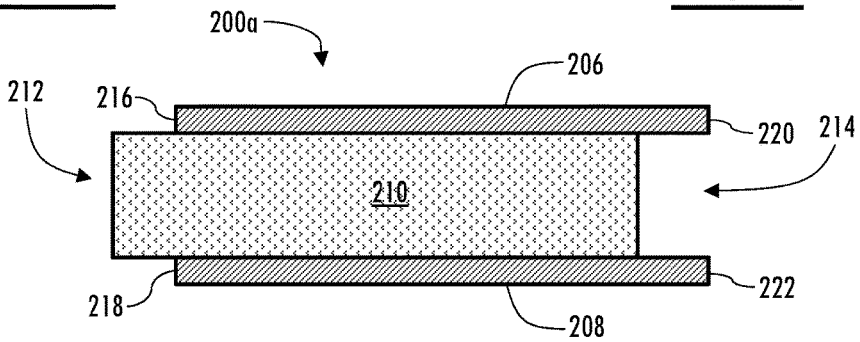
FIG. 6 is a side cutaway view of the floor panel of FIG. 4.

Referring to FIGS. 4-6, a first example of a floor panel 200*a* that may be used with the platform 100 includes a composite structure having a rigid cover including a planar upper surface 206 and a planar lower surface 208 positioned on opposed sides of a foam core 210.

The composite structure may be lightweight and resistant to heat, water, rot, pests, and other common environmental problems, associated with degrading wood structures. The foam core may be made of a polymeric foam material such as expanded polystyrene, expanded polyurethane, phenolic foam, and/or extruded polystyrene for example. The rigid cover may be made of a rigid polymer sheet material such as, for example, fiberglass-reinforced phenolic resin, fiberglass-reinforced polyester, extruded polystyrene, extruded polyurethane, or the like. The rigid cover is bonded to the core with an adhesive. The selection of core materials and cover materials will depend on the intended use of the platform 100 and its desired properties.

The exterior edges of the floor panels 200 may be capped to cover the foam core 210 for substantially preventing water and/or pest intrusion and to enhance the strength of the edges. Suitable capping materials include, but are not limited to, metals such as steel, aluminum, stainless steel, and galvanized metals; and fiber-reinforced polymer materials.

The planar upper surface 206 and planar lower surface form a tongue joint member 212 and a groove joint member 214 on opposed sides of the panel 200*a*. To form the tongue joint member 212, a first peripheral edge 216 of the upper planar surface 206 and a first peripheral edge 218 of the lower planar surface 208 terminate over the foam core 210 such that the foam core 210 extends beyond these peripheral edges 216,218.

To form the groove joint member 214, a second peripheral edge 220 of the upper planar surface 206 and a second peripheral edge 222 of the lower planar surface 208 terminate beyond the foam core 210 such that these peripheral edges 220,222 extend beyond the foam core 210 forming a groove between the upper planar surface 206 and lower planar surface 208.

Figure 7:
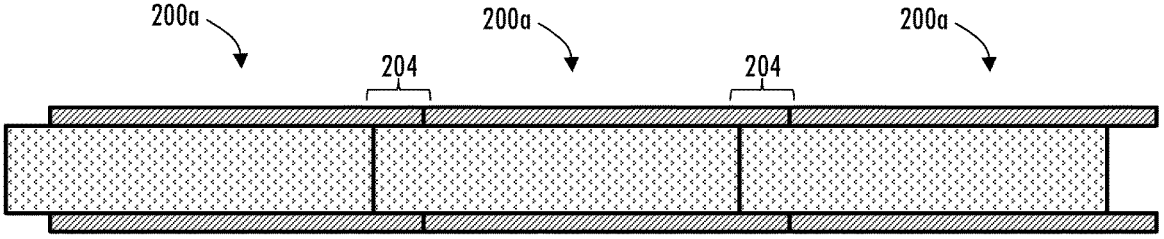
FIG. 7 is a side cutaway view of three of the floor panels of FIG. 4 interlocking to form tongue and groove joints.

Referring to FIG. 7, by mating adjacent tongue joint members 212 and groove joint members 214, the floor panels 200*a* become interconnected by the tongue and grove joints 204.

Figure 8:
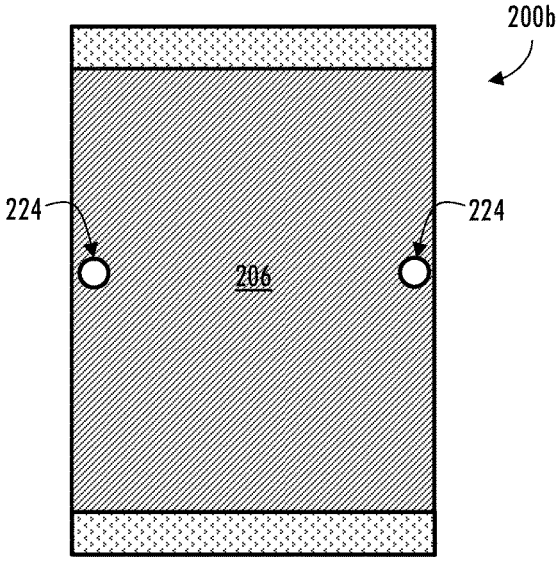
FIG. 8 is a top plan view of a second example of a floor panel.
Figure 9:
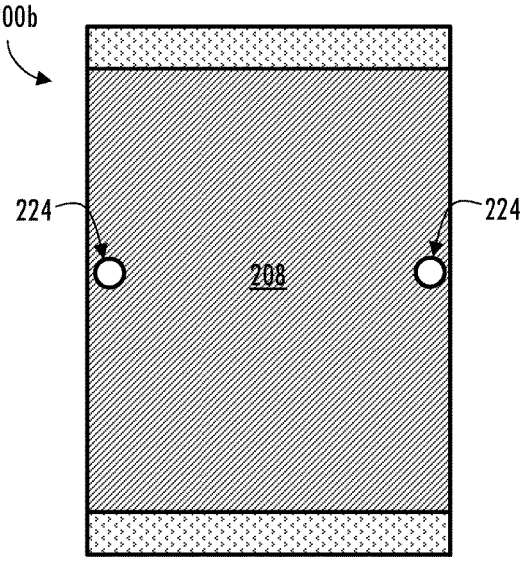
FIG. 9 is a bottom plan view of the floor panel of FIG. 8.
Figure 10:
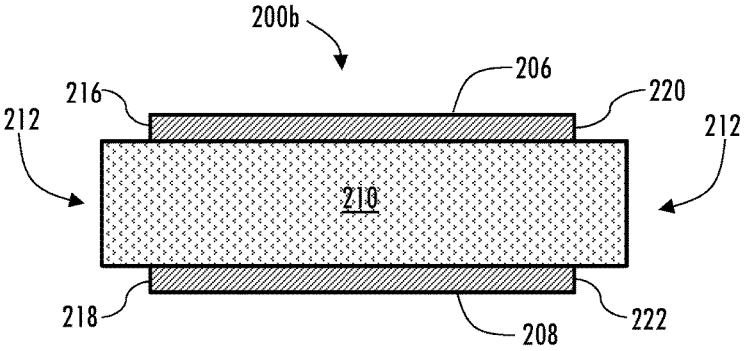
FIG. 10 is a side cutaway view of the floor panel of FIG. 8.
Figure 11:
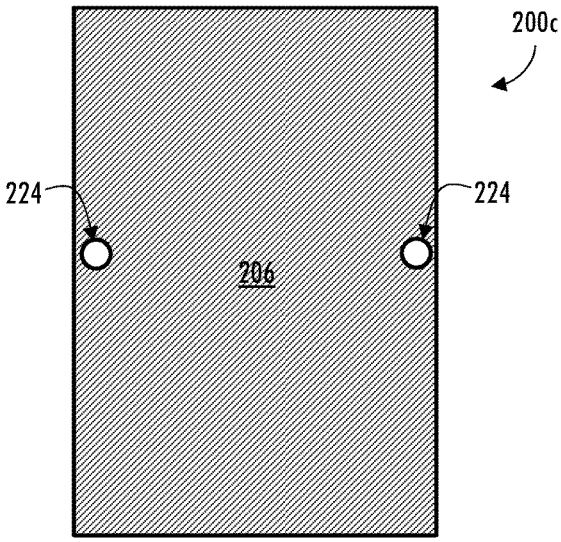
FIG. 11 is a top plan view of a third example of a floor panel.
Figure 12:
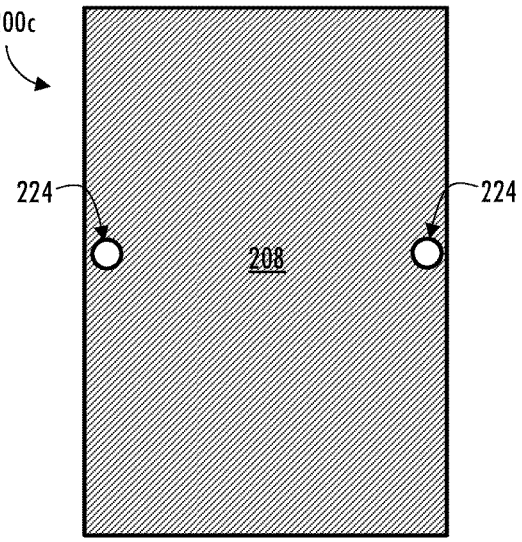
FIG. 12 is a bottom plan view of the floor panel of FIG. 11.
Figure 13:
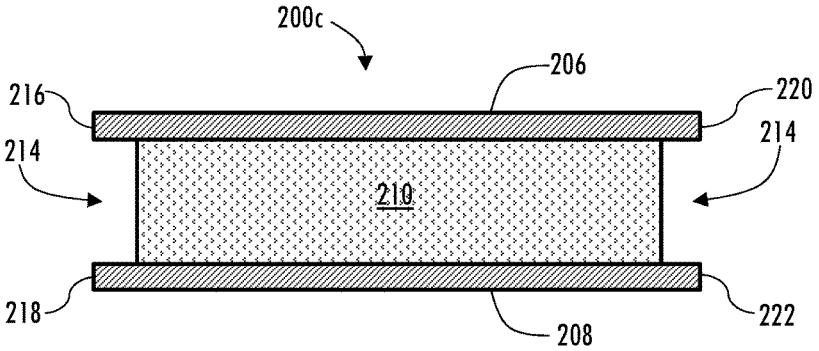
FIG. 13 is a side cutaway view of the floor panel of FIG. 11.

Alternate examples of possible floor panel 200 configurations are in FIGS. 8-13, using the same reference numerals for like features. In the example of FIGS. 8-10 the floor panel 200*b* includes two tongue joint members 212. In the example of FIGS. 11-13, the floor panel 200*c* includes two groove joint members 214.

Figure 14:
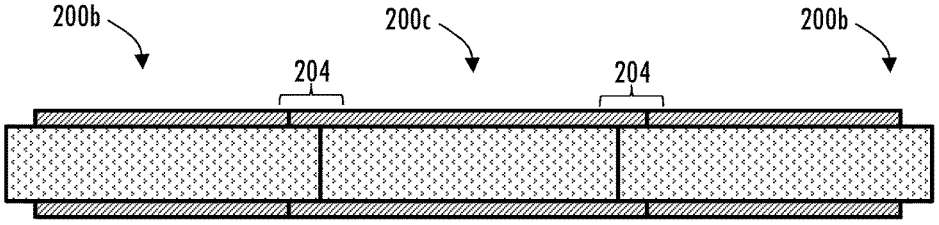
FIG. 14 is a side cutaway view of the floor panels of FIGS. 8 and 11 interlocking to form tongue and groove joints.

Referring to FIG. 14, the floor panels 200*a* and 200*b* may be interconnected by mating adjacent tongue joint members 212 and groove joint members 214 to form the tongue and grove joints 204.

The floor panels 200 may be configured in many other ways than the three examples shown and described here, thus the scope of possible configurations is not limited to only the examples in the drawings.

Figure 15:
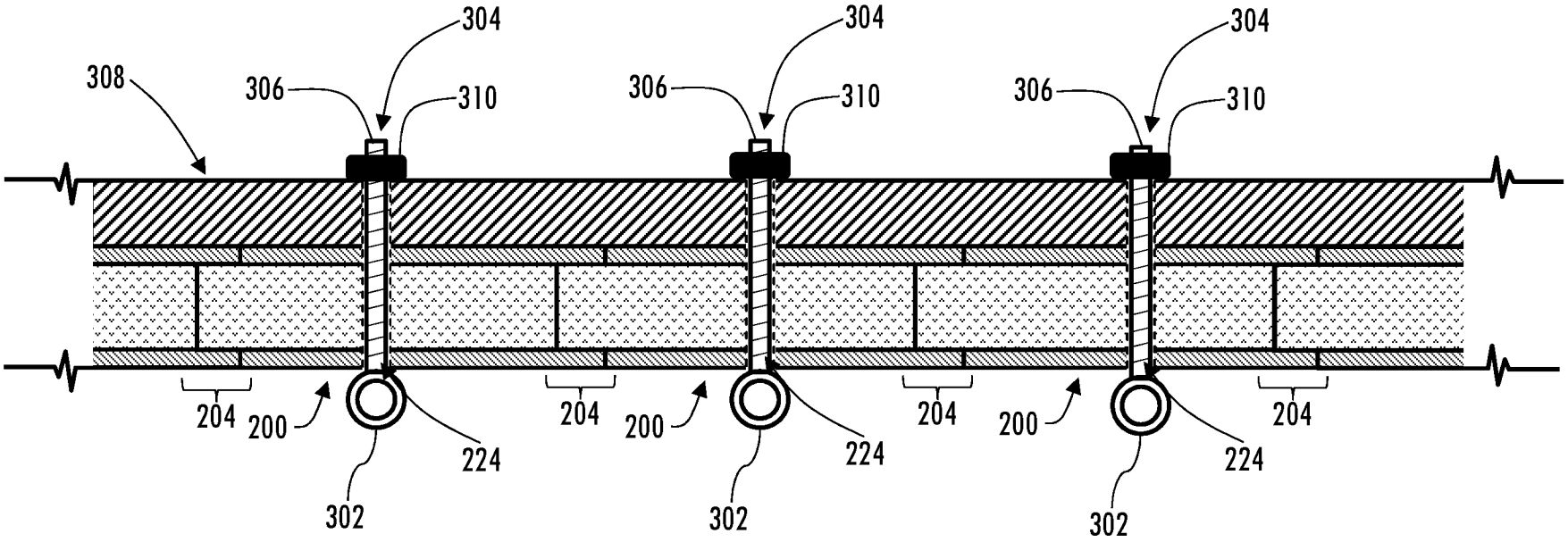
FIG. 15 is a side cutaway view of a portion of the platform of FIG. 1.

Referring to FIG. 15, interlocked floor panels 200 may be attached to the frame 300 by a floor panel attachment mechanism 304 adapted to affix the floor panels 200 to the frame 300. There are many possible attachment mechanisms 304, but in the example shown, the attachment mechanism 304 includes a threaded fastener 306 secured to an upper section 308 of the frame 300 with a mating threaded fastener 310 such as a nut or the like.

The anchors 302 may be attached and extend directly from the frame 300 or, as in the case shown, may form part of the threaded fastener 306, making the threaded fastener and eye bolt or the like.

The threaded fastener 306 extends through a hole 224 in the floor panel 200 such that the anchor 302 extends from the underside of the floor panel 200 and the mating threaded fastener 310 is positioned on the upper section 308 of the frame 300.

The attachment mechanism 304, regardless of its form, may in certain examples, be attached the frame 300 in such a way that the floor panels 200 are suspended from the upper section 308 of the frame 300.

Referring to FIG. 16, a first example of a leg 400*a* that may be used with the platform 100 includes a base 402 having a tubular member 404 extending upwardly therefrom. The top of the tubular member 404 includes a threaded section 406, such as a nut or threads on an interior wall of the tubular member 404.

A threaded rod 408 extends from within the tubular member 404 as indicated by dashed line and upwardly above the threaded section 406, which is mated with the threaded rod 408. A height adjustment mechanism 410 attached to the threaded rod 408 functions as a handle-like feature for allowing a user to raise and lower the threaded rod 408 by screwing it up or down. Atop the threaded rod 408 is a horizontal platform 412 having a mounting block 414 attached thereto. A portion of the horizontal platform 412 extends beyond the peripheral edge of the floor panel 200 positioned on the mounting block 414. That portion includes a hook mechanism 416 thereon.

The leg 400*a* may be secured in place by burying at least a portion of the leg in the terrain T where the platform 100 is to be constructed.

Figure 19:
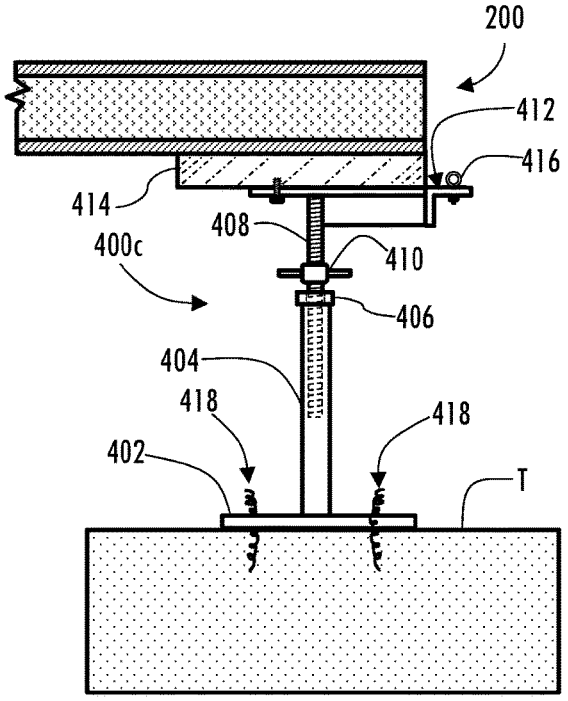
FIG. 19 is a schematic of a third example of a leg.

Alternate examples of possible leg 400 configurations are shown in FIGS. 17-19, using the same reference numerals for like features. In FIG. 17, the leg 400*b* includes a deflection plate 417 attached to the tubular member 404. When buried, the deflection plate 417 helps maintain the position of the leg 400*b* by preventing the leg from swaying substantially due to movement of the platform 100, which might occur in loose terrain and/or in windy conditions. The deflection plate 417 may be rigid and made of corrosion resistant material such as corrosion resistant metal or plastic.

In FIG. 19, the base 402 of the leg 400*c* is positioned on the surface of the terrain T. The base 402 is secured to the terrain T with a plurality of terrain anchors 418 that extend through the base 402 and into the terrain T. Although a spiral-shaped post ground anchor is shown in FIG. 18, the terrain anchors may take many different forms and are not necessarily limited to spiral-shaped post ground anchors.

The legs 400 may be made of any material suitable to support the weight of the platform and anything on the platform 100. Metals are suitable, especially corrosion resistant metals such as stainless steel, galvanized steel, or other galvanized metals, for example.

Figure 20:
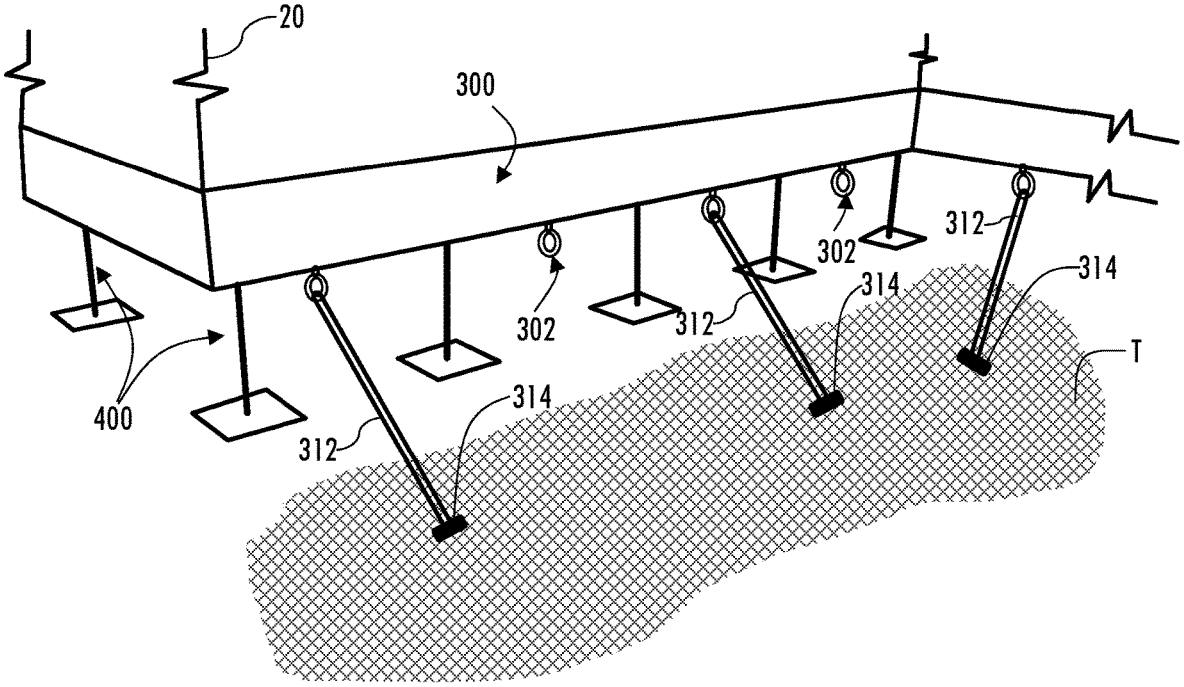
FIG. 20 is a perspective view of a portion of the platform underlying a hard-sided building.
Figure 21:
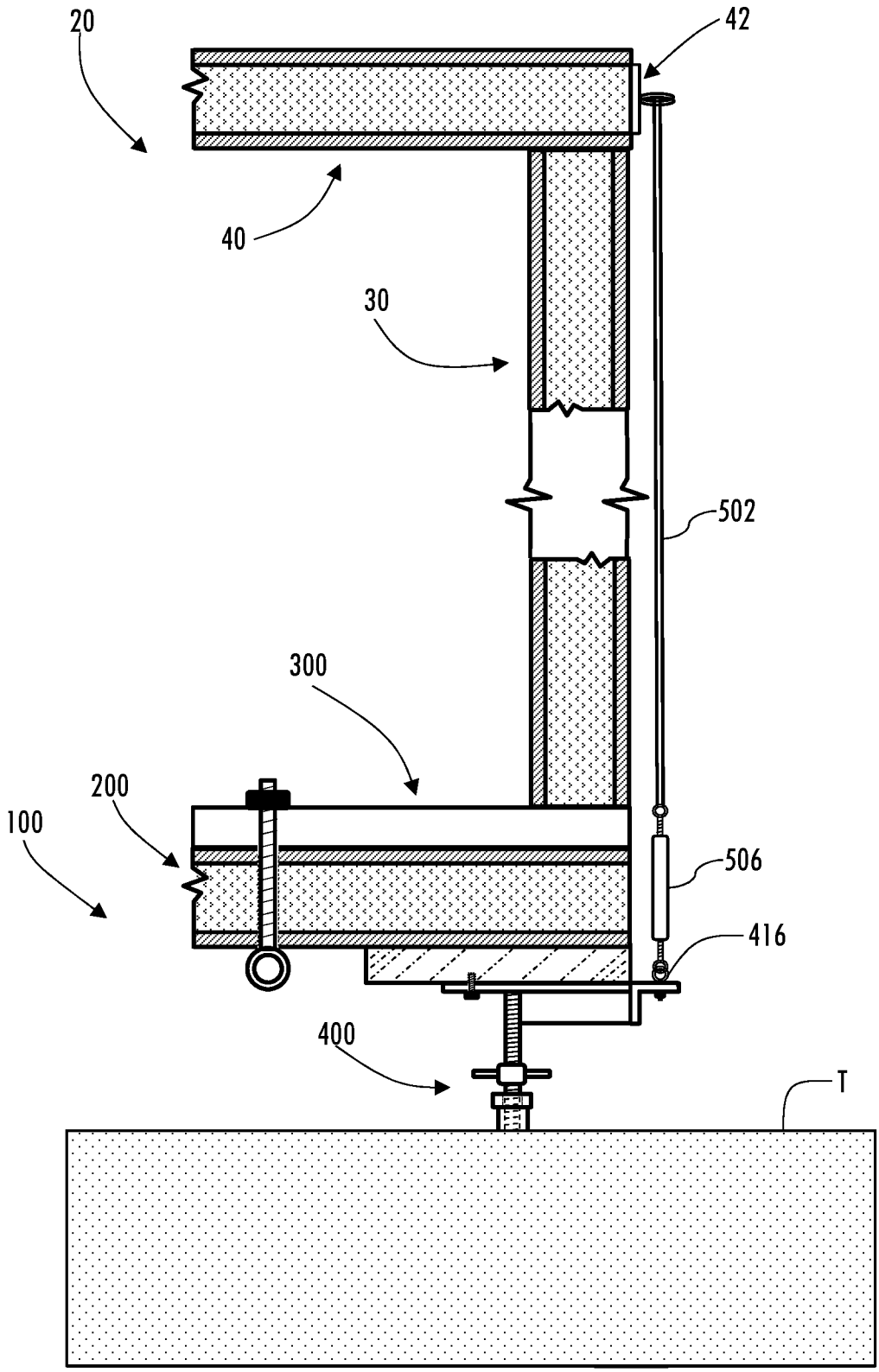
FIG. 21 is a schematic of a portion of the platform of FIG. 1, supporting a hard-sided building.

Referring to FIG. 20, the platform 100 is shown with a building 20 thereon to illustrate a possible function of the anchors 302. The anchors 302 may be used to secure the platform to the terrain T by connecting the anchors 302 to a support line 312 that is mounted to the terrain with a second terrain anchor 314, which may be the same or a different type of terrain anchor as the first terrain anchor 418. The support line may be a rope, cable, or the like Referring to FIG. 21, if a building 20 is erected on the platform 100, the building 20 may include a wall structure 30 and a roof structure 40 made of the floor panels 200. If desired, the structural integrity of the building 20 may be enhanced by connecting the hook mechanism 416 to the roof structure 40. This may be achieved many different ways. In the example of FIG. 21 an attachment line 502 is attached at one end to the hook mechanism 416 and is attached to the roof structure 40 at the other end via a mounting bracket 42. Tension on the attachment line 502 is adjustable by a tensioning member 506 that can be turned to adjust the tension on the attachment line 502. The tensioning member in the example shown is a turnbuckle.

The floor platform 100 is advantageously designed to be modular and portable so that it can be erected, taken apart, and shipped to different locations repeatedly. Accordingly, it is also designed to be relatively lightweight compared to conventional wooden platforms.

Figure 22:
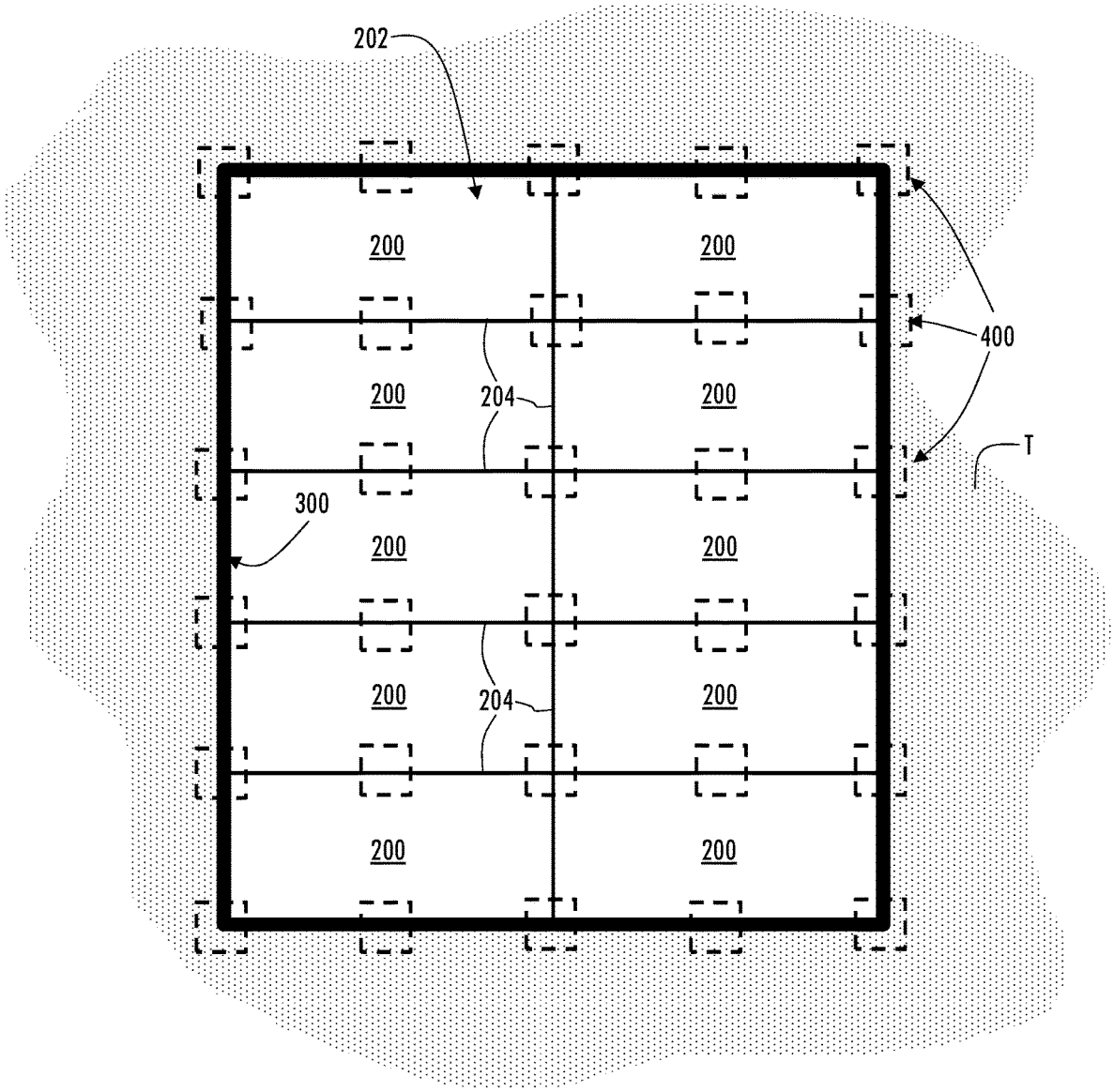
FIG. 22 shows an example of the floor platform positioned over underlying terrain with the legs shown in dashed lines in place.

A method of constructing a floor platform is now described by referring to FIG. 22. This method may be used to construct the floor platform 100 described above. FIG. 22 shows an example of the floor platform 100 positioned over underlying terrain T with the legs 400 shown in dashed lines in place. In this example, the frame 300 only extends around the perimeter of the floor 202 and does not include any cross beams extending between its perimeter boundaries. To upwardly support the floor panels 200, at least some of the legs 400 are positioned in such a way that a respective leg 400 is in direct contact with a tongue and groove joint 204. This arrangement supports the tongue and groove joint 204 from underneath so that heavy cross-beams are not always necessary or can be minimized.

Because it is known where the tongue and groove joints are located, it is possible to know where to position each leg 400 on the terrain T based on a pre-determined grid pattern associated with where the frame 300 and joints 204 will be. The grid pattern including measurement may be provided as written instructions for the user to follow.

Once the legs 400 are positioned in the proper locations on the terrain T, the height of each leg 400 may be adjusted so that the mounting blocks 414 are on the same level plane prior to installing the floor panels 200. Because the legs are independently height adjustable, the fact that the terrain might be uneven does not matter with respect to providing a level floor.

The floor panels 200 may be interconnected with the tongue and groove joints 204 and placed on the legs 400. The frame may be placed around the perimeter of the floor 202 formed by the floor panels 200 and attached to the periphery of the floor panels 200 bounding the perimeter of the floor 202.

The floor platform 100 has many uses, but it is particularly advantageous for use in connection with temporary shelters such as those used by military forces or by humanitarian operations. The platform is designed to replace conventional wooden platforms that rot and cannot be easily constructed, taken apart, transported, and re-constructed repeatedly.

This disclosure describes example aspects and embodiments, but not all possible aspects embodiments of the modular floor platform and associated methods. Where a particular feature is disclosed in the context of a particular aspect or embodiment, that feature can also be used, to the extent possible, in combination with and/or in the context of other aspects and embodiments. The platform and its associated methods may be embodied in many different forms and should not be construed as limited to only the embodiments described here.

That which is claimed is:

1. A modular floor platform comprising:

a floor made of a plurality of individual composite floor panels interconnected by tongue and groove joints, the individual composite floor panels being made of a floor panel material having a foam core and a rigid cover over the foam core, at least one of the individual composite floor panels along a perimeter of the floor including a hole formed therein adjacent the perimeter of the floor, the perimeter of the floor being an outer boundary of the floor;

a frame attaching the floor panels together along the perimeter of the floor, the frame extending around the perimeter of the floor, the frame including a floor panel attachment mechanism that extends into the hole; and legs beneath the frame and upwardly supporting the floor along the perimeter of the floor;

a wall structure made of the floor panel material upwardly extending from the floor;

a roof structure made of the floor panel material forming a roof over the floor and wall structure; and an attachment line connecting the roof structure to the floor, the attachment line being under adjustable tension to improve structural integrity of a building formed from the floor, wall structure, and roof structure.

2. The modular floor platform of claim 1, wherein, the rigid cover includes a planar upper surface and a planar lower surface opposite the planar upper surface, and, on at least some of the floor panels, the planar upper surface and planar lower surface extend beyond a peripheral edge of the foam core forming a groove of the tongue and groove joints between the planar upper surface and planar lower surface.

3. The modular floor platform of claim 1, wherein the rigid cover includes a planar upper surface and a planar lower surface opposite the planar upper surface, and, on at least some of the floor panels, the foam core extends beyond a peripheral edge of the planar upper surface and a peripheral edge of the planar lower surface forming a tongue of the tongue and groove joints.

4. The modular floor platform of claim 1, wherein the legs upwardly support the floor by directly contacting the tongue and groove joints.

5. The modular floor platform of claim 1, wherein the floor includes at least one tongue and groove joint not directly contacting the frame and at least one of the legs upwardly supports the floor by directly contacting the at least one tongue and groove joint not directly contacting the frame.

6. The modular floor platform of claim 1, wherein the frame includes an upper section and the floor panels are attached to the frame in such a way that the floor panels are suspended from the upper section.

7. A modular floor platform comprising:

a plurality of individual composite floor panels, each floor panel being made of a floor panel material having (a) a foam core positioned between a planar upper surface and a planar lower surface of a rigid cover over the foam core and (b) a peripheral edge defining a tongue and groove joint member; the tongue and groove joint members of adjacent floor panels being mated together forming a flat floor; at least one of the individual composite floor panels along a perimeter of the floor including a hole formed therein adjacent the perimeter of the floor, the perimeter of the floor being an outer boundary of the floor;

a frame attaching the floor panels together along the perimeter of the flat floor in such a way that the frame suspends the floor panels from an upper section of the frame, the frame including a floor panel attachment mechanism that extends into the hole;

legs beneath the frame and upwardly supporting the floor along the perimeter of the flat floor;

a wall structure made of the floor panel material upwardly extending from the floor;

a roof structure made of the floor panel material forming a roof over the floor and wall structure, the roof structure including a mounting bracket located at roof structure perimeter; and an attachment line connecting the mounting bracket to the floor, the attachment line being under adjustable tension to improve structural integrity of a building formed from the floor, wall structure, and roof structure.

8. The modular floor platform of claim 7, wherein the planar upper surface and planar lower surface extend beyond a peripheral edge of the foam core forming a groove of the tongue and groove joint member between the planar upper surface and planar lower surface.

9. The modular floor platform of claim 7, wherein the foam core extends beyond a peripheral edge of the planar upper surface and a peripheral edge of the planar lower surface forming a tongue of the tongue and groove joint member.

10. The modular floor platform of claim 7, wherein the legs upwardly support the floor by directly contacting the floor where the tongue and groove joint members mate.

11. The modular floor platform of claim 7, wherein the floor includes at least one tongue and groove joint not directly contacting the frame and at least one of the legs upwardly supports the floor by directly contacting the at least one tongue and groove joint not directly contacting the frame.

12. The modular floor platform of claim 7, wherein the frame suspends the floor panels from an upper section of the frame with an elongated fastener extending through the frame and completely through the floor panels.

13. A method of constructing a floor platform, the method comprising:

arranging a plurality of legs on terrain in a pre-determined grid pattern;

forming a floor upwardly supported on the legs by interconnecting tongue and groove joints of a plurality of individual composite floor panels made of floor panel material and positioning respective tongue and groove joints against respective legs, at least one of the individual composite floor panels along a perimeter of the floor including a hole formed therein adjacent the perimeter of the floor, the perimeter of the floor being an outer boundary of the floor;

attaching the floor panels together along the perimeter of the floor with a frame that extends around the perimeter of the floor and includes a floor panel attachment mechanism;

inserting the floor panel attachment mechanism into the hole;

creating a wall structure made of the floor panel material so that the wall structure upwardly extends from the floor;

placing a roof structure made of the floor panel material to form a roof over the floor and wall structure, the roof structure including a mounting bracket located at a roof structure perimeter; and increasing tension on an attachment line connecting the mounting bracket to the floor to improve structural integrity of a building formed from the floor, wall structure, and roof structure.

14. The method of claim 13, wherein the individual composite floor panels have a foam core and a rigid cover over the foam core and the rigid cover includes a planar upper surface and a planar lower surface opposite the planar upper surface, and, on at least some of the floor panels, the planar upper surface and planar lower surface extend beyond a peripheral edge of the foam core forming a groove of the tongue and groove joints between the planar upper surface and planar lower surface.

15. The method of claim 13, wherein the individual composite floor panels have a foam core and a rigid cover over the foam core and the rigid cover includes a planar upper surface and a planar lower surface opposite the planar upper surface, and, on at least some of the floor panels, the foam core extends beyond a peripheral edge of the planar upper surface and a peripheral edge of the planar lower surface forming a tongue of the tongue and groove joints.

16. The method of claim 13, wherein the legs upwardly support the floor by directly contacting the tongue and groove joints.

17. The method of claim 13, wherein the floor includes at least one tongue and groove joint not directly contacting the frame and at least one of the legs upwardly supports the floor by directly contacting the at least one tongue and groove joint not directly contacting the frame.

18. The method of claim 13, wherein the frame includes an upper section and the floor panels are attached to the frame in such a way that the floor panels are suspended from the upper section.

19. The modular floor platform of claim 1, wherein the rigid cover includes a planar upper surface and a planar lower surface opposite the planar upper surface, and the hole is formed through the planar lower surface.

20. The modular floor platform of claim 7, wherein the rigid cover includes a planar upper surface and a planar lower surface opposite the planar upper surface, and the hole is formed through the planar lower surface.

* * * * *